US005806591A

United States Patent [19]

Sable et al.

[11] Patent Number: 5,806,591

[45] Date of Patent: Sep. 15, 1998

[54] ROD GUIDE

[76] Inventors: Donald E. Sable, 4301 Edmondson Ave., Dallas, Tex. 75205; Donald E. Sable, II, 7701 N. Classen Blvd., Oklahoma City, Okla. 73116

[21] Appl. No.: 826,776

[22] Filed: Apr. 7, 1997

Related U.S. Application Data

[63] Continuation-in-part of Ser. No. 518,592, Aug. 14, 1995, Pat. No. 5,613,556.

[51] Int. Cl.[6] ..... E21B 17/10

[52] U.S. Cl. ..... 166/241.4; 175/325.1

[58] Field of Search ..... 166/241.1, 241.2, 166/241.4, 241.5, 241.6; 175/325.1, 325.5

[56] References Cited

U.S. PATENT DOCUMENTS

| | | | |
|---|---|---|---|
| 1,583,262 | 5/1926 | Smith | 166/241.2 |
| 4,997,039 | 3/1991 | Sable | 166/241.4 |
| 5,115,863 | 5/1992 | Olinger | 166/241.5 |
| 5,191,938 | 3/1993 | Sable et al. | 166/378 |
| 5,339,896 | 8/1994 | Hart et al. | 166/241.1 |
| 5,358,041 | 10/1994 | O'Hair | 166/241.4 |
| 5,452,760 | 9/1995 | Bertagnolli | 166/176 |

*Primary Examiner*—Frank Tsay

[57] ABSTRACT

A rod guide for maintaining a rod of a sucker rod string in substantially central position in a well tubing during reciprocal movement of the sucker rod string in the well tubing.

8 Claims, 3 Drawing Sheets

ROD GUIDE

This application is a continuation in part of allowed application Ser. No. 08/518,592 filed Aug. 14, 1995, now U.S. Pat. No. 5,613,556, by Donald E. Sable and Donald E. Sable, II.

This invention relates to well tools and more particularly to guides for the rods of a sucker rod string for maintaining the rod in substantially central position in a well tubing during reciprocal movement of the sucker rod string in the well tubing.

BACKGROUND OF THE INVENTION

As is disclosed in the co-pending application, the usual apparatus for pumping well fluids from a well in the surface through a tubing, which extends from the surface to a fluid producing formation penetrated by the well bore, includes a pump connected to the lower end of the tubing which has a plunger or "travelling valve" which is reciprocated in the longitudinal barrel of the pump by a string of sucker rods, the bottom rod being connected to the travelling valve, the top rod of the rod string being connected to a motor driven means for alternately pulling the strings upwardly and then allowing the string to be moved downwardly by gravity.

Since the weight of the pump rod string provides the force necessary to cause well fluids to flow upwardly through the tubing, if resistance to the downward movement of string of tubing by the upwardly flowing well fluids is great, especially past such obstructions to fluid flow as rod guides or scrapers mounted on the rods, the rod string will move downwardly relatively slowly thus reducing the rate of production of the well fluids. The rod guides of course decrease the flow space area between the rod and the tubing having radially outwardly extending longitudinal ribs for engaging the internal surfaces of the well tubing to limit the lateral displacement of the rod in the tubing. In addition, if the pump and lower end portions of the rod string offer a relatively great resistance to downward movement of the rod string, the weight of upper portions of the rod string may cause lower portions of the rod string to be placed under great compression loads which tend to cause such lower portions to bend and buckle and their rod guides to be moved laterally and pressed with great force against the internal surfaces of the tubing.

The rod guides at locations where the rod is not centrally positioned in the well tubing rub against the internal surfaces of the well tubing over the distance, for example, six feet, of the reciprocal movement of the sucker rod string during pumping operation. The rod guides accordingly must be formed of a substance which is hard and durable, but which does not have such abrasive characteristics as to abrade or erode the well tubing to such an extent that the well tubing is damaged and even broken. The substance of which the rod guides are formed must also be durable so that the rod guides themselves are not worn away or eroded in relatively short time period of the reciprocating operation of the rod string.

Since the well tubing itself may not be perfectly vertical and be bent at various locations along its length the rod guides must limit the lateral displacement of the rod relative to the central longitudinal axis of the well tubing at such locations. The ribs of the rod guides at locations of deviated or bent portions of the tubing or of the rod string will abrade or erode since they slide in frictional engagement with the internal surfaces of the well tubing. The two ribs of the rod guide which engage the well tubing at such locations would be worn away quickly and allow portions of the string, as at the locations of the upsets at the ends of each rod by which the rods are connected to one another, actually to come in metal-to-metal contact with the internal surfaces of the tubing and so damage the tubing as well as the rods themselves.

In many installations the well head equipment at the surface of the well includes a rotator which rotates the rod string a few degrees in a step by step manner so that all ribs are sequentially moved into contact with the internal surfaces of the well tubing at such locations of the curvature or lateral displacement of the tubing or the rod string so as to lengthen the time before the failure of the rod guide due to excessive wear of its ribs.

At some locations of lateral displacement of the rod guide string relative to the longitudinal axis of the tubing, the guide ribs which engage the internal surfaces of the tubing to limit such lateral displacement may be held with such great force against the inernal surface of the well tubing that the portions of the rod string between such rotator and such rod guide may actually twist 360 degrees or more, especially if the length of such portions are of great length, a thousand or more feet, before sufficient torque force is exerted on the rod to cause the rod at such location to be rotated until the violently and rapidly engagement of another rib with the well tubing again limits such lateral displacement and rotation. Once the rotation of the rod has started, the rod may rotate rapidly relative to the tubing with consequent damage to the tubing and the ribs which engage it during such violent rotation of the rod string.

It is also desirable that in one form the rod guide of the invention have means for ensuring that during the rotation of the rod string a least two ribs radially spaced apart be continuously in engagement with the well tubing at the locations of lateral displacement of the rod string relative to the well tubing in order to prevent abrupt rotational movement of the rod as rib moves out of engagement with the tubing before another rib engages the tubing since abrupt jerking rotation of the rod string may actually cause damage to the rod guides and to the well tubing.

In addition, the rod guides should provide a relatively low resistence to upward flow of well fluids therepast and therefore to the downward movement of the rod string in the tubing as has been disclosed in the U.S. Patents to Donald E. Sable U.S. Pat. No. 4,809,777 and U.S. Pat. No. 4,997,039. The rod guides should also minimize the turbulence in the well fluids flowing therepast during the reciprocatory movement of the rod string in the well tubing which not only increases the resistence to upwardly flow of the well fluids, but also tends to wear away and damage the rods of the rod string and the internal surfaces of the well tubing, specially if the well fluids include abrasive particles, such as sand, or corrosive chemicals.

The plastic substances available and suitable for use to form the rod guides are hard and durable, but somewhat brittle so that the length of the bodies of the rod guides which regidify the longitudinal portions of the rod shank on which they are rigidly mounted are limited because the rods are pressured to bend laterally thus cracking the bodies of the rod guide.

The ribs of the rod guides which engage the internal surfaces of the well tubing should preferably provide a fairly large area of contact with the well tubing at locations of their sliding engagement therewith in order to minimize the per unit area pressure or force with which the ribs are forced into engagement with the well tubing, both to minimize wear of the ribs and the wear and abrasion of the well tubing itself.

While the rod guides disclosed in the U.S. Patent to Donald E. Sable U.S. Pat. No. 4,997,039 minimizes the damage to the elongate rod guide body caused by the bending of the rod by providing a circular area of low mechanical strength and decreased radius in order to cause any such damage or cracking of the rod guide to be limited to a central area between two longitudinally spaced pairs of guide ribs, the cracking of the body at such locations of the rod guide body exposes the rod at the locations of such cracks to the well fluids and increases the turbulence thereof at such locations. The rods are cleaned of all dirt and coating substances in order to prevent outgasing therefrom and provide great adherence of the guide bodies to the rod shanks. Since the rod is not coated with any corrosion inhibiting material beneath the rod guides, such exposed portions of the rod are more susceptible to damage by turbulences chemical action and abrasion by abrasive particles in the well fluids.

As disclosed in the co-pending application in order to ensure that at all times during the rotation of the rod shank on which it is installed at least two ribs of the guide are in contact with the internal surfaces of the well tubing and prevent rapid and violent rotation of the rod as the rod string is rotated by the rotater as may occur if the rod string is freed to rotate after the guide-tubing contact has held the rod string against rotation and the rod string is twisted.

The co-pending application shows a three unit rod guide that ensures that at all times during the rotation of the rod shank on which it is installed, at least two ribs of the three units are in contact with the internal surfaces of the well tubing to prevent such rapid and violent rotation of the rod as the rod string is rotated by the rotater. The three units spaced on the rod shank requires either a very large mold apparatus which is expensive and requires a relative long period of cooling after the injection of the molten plastic into the cavities of the mold or requires that a second molding operation be performed with each guide unit having two radially and oppositely extending ribs.

OBJECTS OF THE INVENTION

It is therefore an object of this invention to provide guides for the rods of a pump rod string which will limit lateral displacement of the rods in a well tubing.

It is another object of the invention to provide a rod guide having two longitudinally spaced units each having three outwardly extending spaced ribs, the ribs of one unit being displaced from the ribs of the other unit so that the outer surfaces of the ribs of the three units lie in a substantially complete cylindrical plane so that at least two ribs of the units are in contact with the tubing.

It is another object of the invention to provide a rod guide, of the type described, wherein the two units of the rod guide are spaced longitudinally on the shank of the rod guide on which they are mounted, the portion of the rod shank between the two rod guides unit constituting a flex section.

Still another object of the invention is to provide a rod guide, of the type described, whose radially outwardly side surfaces extend convergently from a common elongate body to permit the removal of the rod shank and the guide units molded thereon from the moving apparatus.

SUMMARY OF THE INVENTION

The rod guide assembly for the shank of a sucker rod having two longitudinally spaced units on the rod shank, the portion of the rod shank between the two units constituting a flex section of the rod, the two units each having a tubular body and three circumferentially spaced ribs extending outwardly from the body, the ribs of one unit being displaced circumferentially relatively to the ribs of the other unit whereby the outer arcuate surfaces of the ribs of the other two units lie in a substantially complete cylindrical plane whereby at least two ribs of the units are in constant contact with the internal surfaces of a well tubing when the rod is displaced laterally relative to the tubing the rod guide units limiting the lateral displacement of the rod relative to the tubing.

DESCRIPTION OF THE DRAWINGS

Other objects and advantages of the invention will be readily apparent from the reading of the following description of a rod guide constructed in accordance with the invention and reference to the accompanying drawings:

FIG. 2 is a cross-sectional view taken on line 2—2 of FIG. 1;

Referring to FIGS. 1, 2A, 2B and 2C of the drawings the rod guide 10 embodying the invention is shown mounted on the shank 11 of a sucker rod SR, includes an upper unit 13 and a lower unit 13*a* spaced longitudinally from one another on the shank. The upper unit includes a tubular body 14 whose upper and lower tapered end portions 16 and 17, respectively, extend divergently inwardly to the rod from the upper and lower ends of the tubular body 14. Three circumferentially spaced ribs 21, 22 and 23 extend outwardly from the cylindrical outer surface of the tubular body 14. The top end surfaces 25, 26 and 27 of the ribs 21, 22 and 23, respectively, extend substantially arcuately and downwardly from the lower end of the top end portion 16 to the vertical arcuate outer surfaces 28, 29 and 30 of the ribs 21, 22 and 23, respectively Similarly, the bottom end surfaces 31, 32 and 33, respectively, curve upwardly and outwardly from their rod shank to the lower ends of the vertical surfaces 28, 29 and 30, respectively, from the upper end of the lower end portion 17.

The lower unit 13*a* is identical in structure to the upper unit 13 and accordingly its elements and surfaces have been provided with the same reference numerals to which the subscript "a" has been added as the corresponding elements and surfaces of the upper unit 13.

Figure 1:
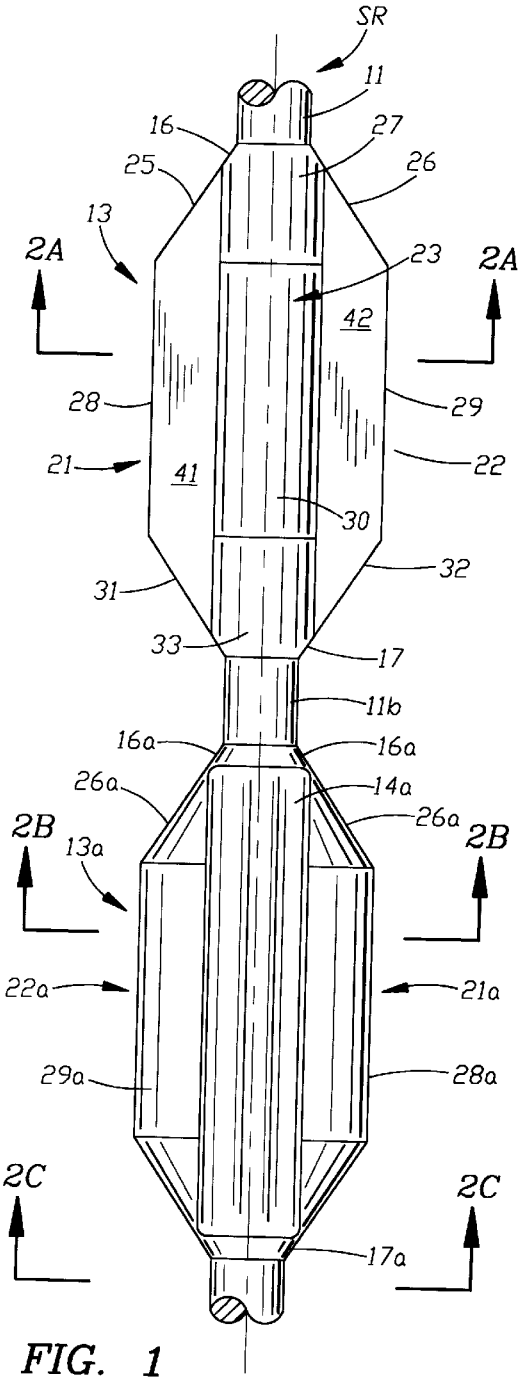
FIG. 1 is a longitudinal plane view of a rod guide embodying the invention mounted on a shank of a sucker rod.
Figure 2A:
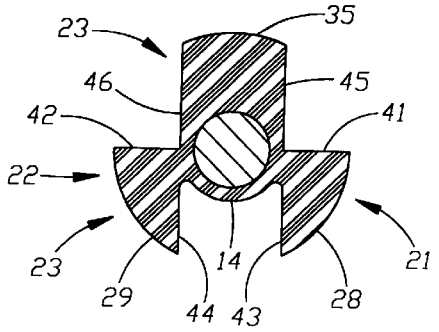
Figure 2B:
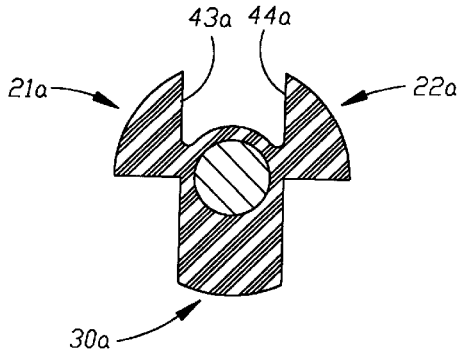
FIG. 2B is a cross-sectional view taken on line 2B—2B of FIG. 1.
Figure 2C:
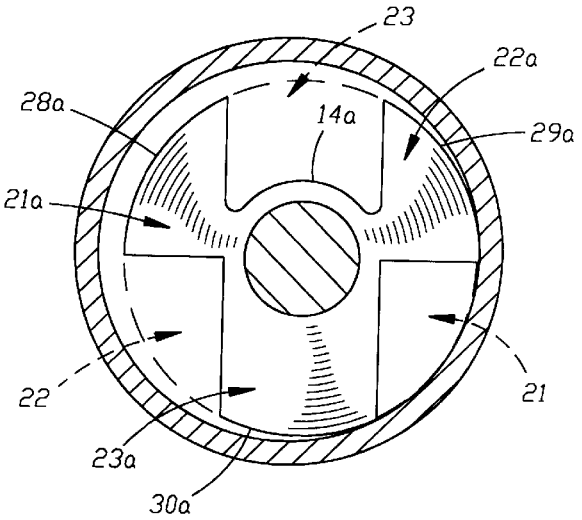
FIG. 2C is a cross-sectional view taken on line 2C—2C of FIG. 1.

The lower unit 13*a* is spaced longitudinally from the upper unit 13 to provide a bend or flex portion 40 of the shank between the lower and upper end portions 17 and 16*a* of the two units which is free of the rigid tubular bodies 14 and 14*a* of the two units and is thus free to flex or bend to the permitted by contact of the ribs of the two units with the internal surfaces of the tubing in which the rod extends and is longitudinally reciprocal therein.

The ribs 21*a*, 22*a* and 23*a* of the lower unit are displaced one-hundred and eighty degrees about the longitudinal axis of the rod relative to the ribs 21, 22 and 23 of the unit 13 as shown in the drawings.

The ribs 21, 22 and 23 and the ribs 21*a*, 22*a* and 23*a* have vertical outer surfaces 28, 29 and 30 and 28*a*, 29*a* and 30*a*, respectively, and lie in a cylindrical plane concentric with the longitudinal central axis of the rod shank. The ribs 21 and 22, have side surfaces 41 and 42 which extend in a plane diametric of the longitudinal axis of the rod shank and their other side surfaces 43 and 44 are substantially parallel to one another but may diverge slightly outwardly to facilitate the release of the unit from the mold cavities and which extend substantially perpendicularly relative to the plane of their side surfaces 41 and 42. The third rib has side surfaces 45 and 46 which converge slightly outwardly to facilitate release of the units from the mold. The surfaces 43 and 44 of the ribs 21 and 22 are spaced a distance substantially equal or somewhat less than the width of the rib 23 between its side surfaces 45 and 46 so that the outer surfaces of the ribs of the two units lie in a cylindrical plane of a diameter slightly less than the diameter of the internal surface of the tubing.

Figure 3:
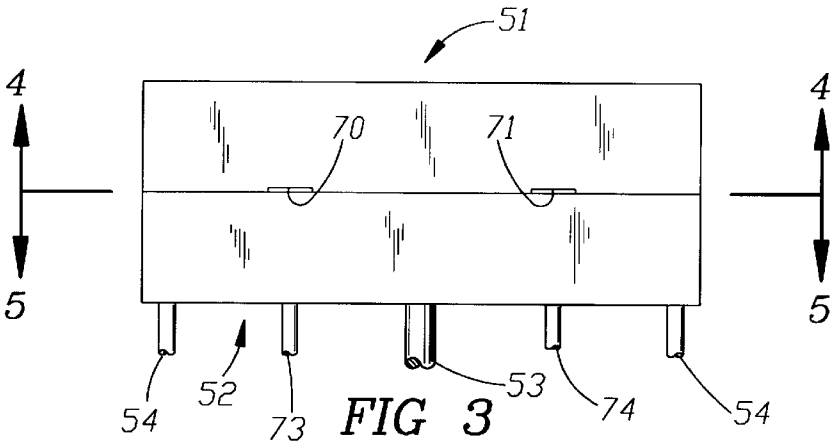
FIG. 3 is a schematic top plane view of a mold apparatus for molding the rod guide units on the shank of a sucker rod.
Figure 4:
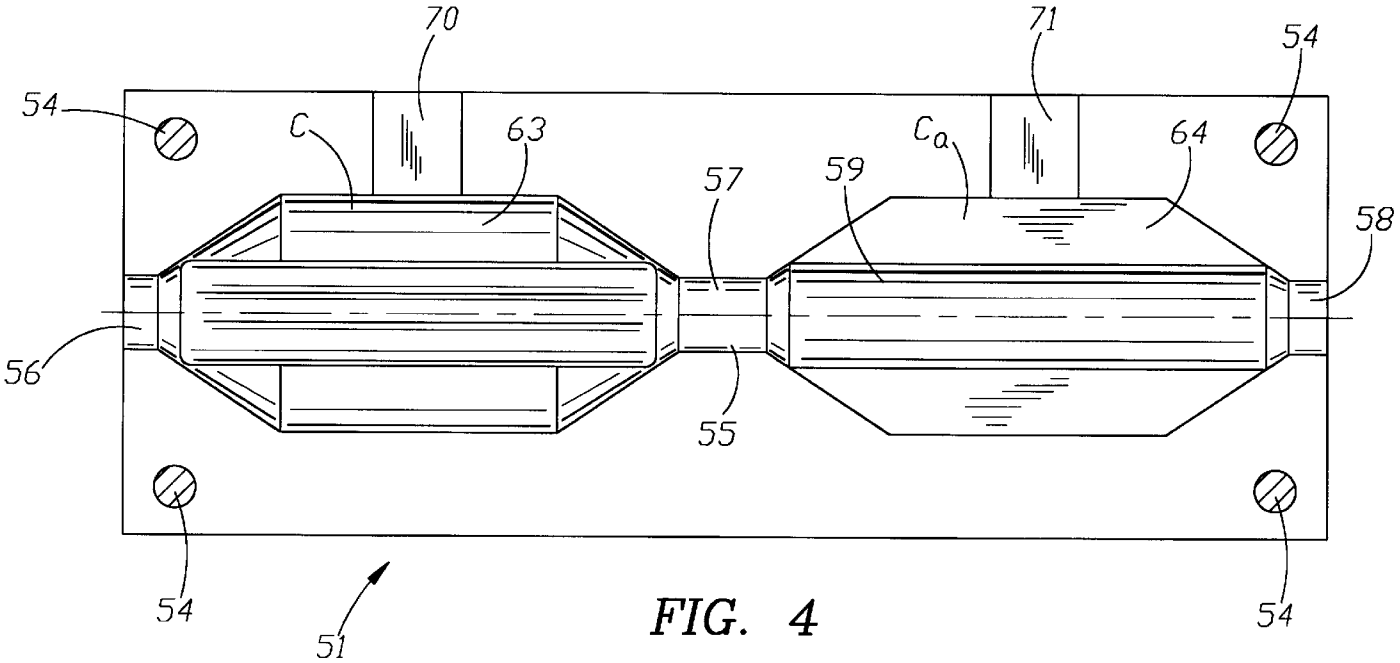
FIG. 4 is a schematic plane view taken on line 4—4 of FIG. 3 showing the fixed blocks of the mold apparatus.
Figure 5:
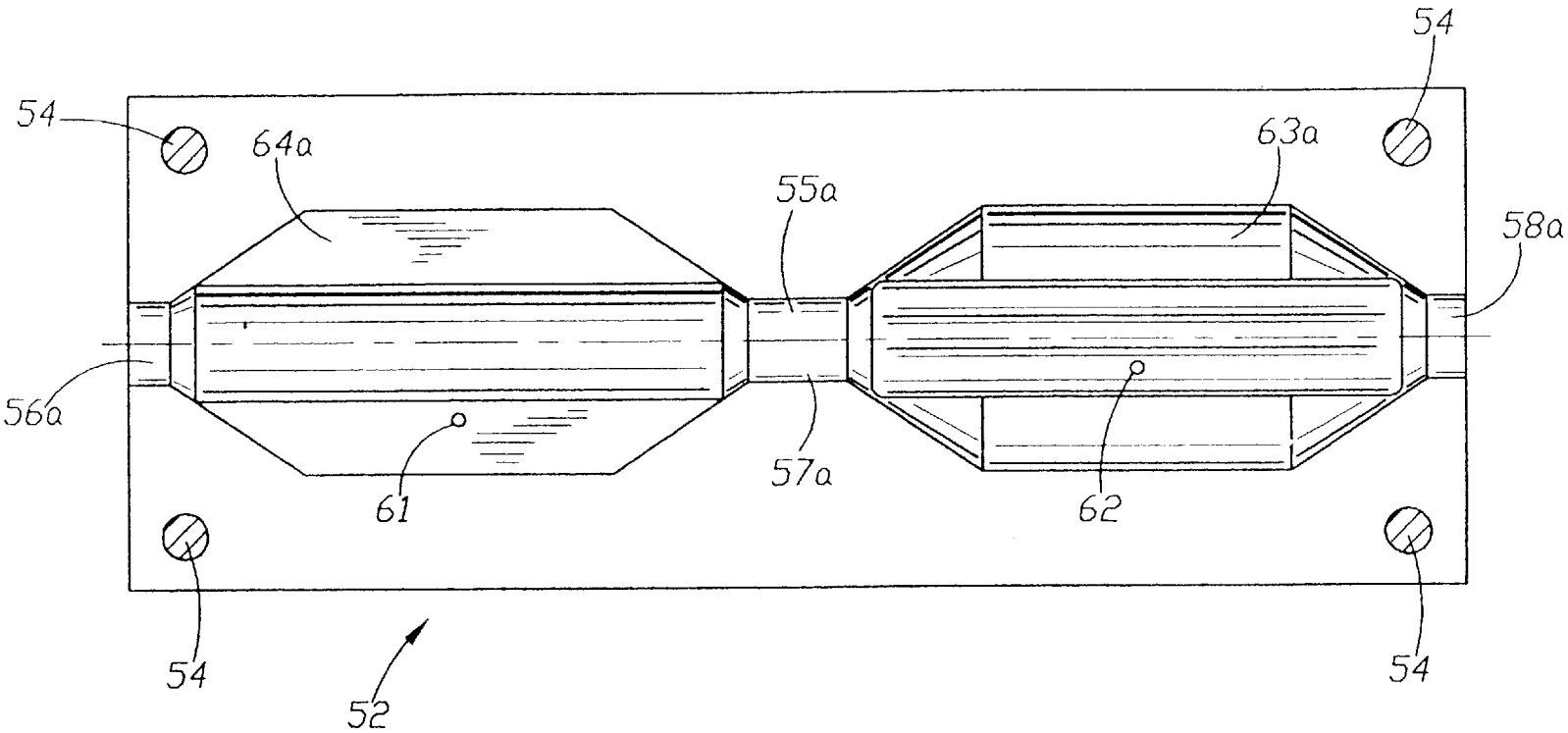
FIG. 5 is a schematic plane view taken on line 5—5 of FIG. 3 of the movable block of the mold apparatus.

Referring now to FIGS. 3, 4 and 5 of the drawings the mold apparatus 50 for simultaneously molding the two guide units on the shank of the sucker rod is shown schematically as having stationary and movable platens or blocks 51 and 52, respectively. The movable block is mounted for horizontal movement relative to the stationary block by a shaft 53 on slide bars or poles 54 rigidly secured to the stationary block which extend slidably through suitable apertures in the movable block. The block 51 has a pair of recesses 53 and 54 and a semi-circular recess 55 which connects the ends of the recesses 53 and 54.

The recesses 53*a* and 54*a* of the movable block are identical in configuration with the recesses 53 and 54 of the fixed block 51 and, accordingly have been provided with the same reference numerals, to which the subscript "a" has been added, as the corresponding elements defining the recesses 53 and 54 of the fixed block. The recesses 53 and 54 are aligned with the recesses 54*a* and 53*a* recesses 54*a* and 53*a* to form cavities C amd Ca having the configuration of the guide units 13 and 13*a*, respectively, when the movable block is moved into contact with the fixed block and the rod shank is engaged by the aligned pairs of block surfaces 56 and 58*a*, 57 and 57*a* and 58 and 56*a*.

The mold apparatus has been shown schematically and it will be well known to those skilled in the art that suitable seal inserts may be provided to form the circular seal surfaces at the arcuate semi-circular surfaces 56 and 58*a*, 57 and 57*a* and 58 and 56*a* which will engage the rod shank and prevent any flow of plastic liquid therepast.

It will also be apparent to those skilled in the art that the two blocks may be provided with cooling means, such as passages to which cooling liquids may be pumped after the injection of the hot plastic into the cavities and about the rod shank to shorten the time required for the plastic to solidify.

It will also be apparent to those skilled in the art that the block 51 may be provided with vent means such as the recesses 70 and 71 to permit gases to escape from the cavities, but the slots are so narrow as to prevent flow of liquid plastic therethrough.

The hot liquid substance is injected into the cavities C and C1 through sprues 61 and 62 to which the hot liquid substance under pressure is applied through flexible conduits 73 and 74 from a suitable pressurized source of the molten plastic substance.

The molding apparatus has shown schematically, since its operation and structure, its various controls heating and cooling means being well known.

The guide units are formed of a suitable durable plastic such as polythenylene sulfide, commercially available under the trademark "RYTON" or other rigid very durable plastic such as "NYL/60/66" or a glass filled nylon "NYL/6/6 or the like.

It will now be seen that the fixed and movable blocks have recesses therein of identical configuration, but that the cavities of the movable block are reversed longitudinally relative to those of the fixed block so that the ribs of the two units are displaced one hundred and eighty degrees relative to one another about the longitudinal axis of the rod shank on which they are positioned with the ribs of one unit being positioned in alignment to the spaces between the ribs of the other unit. The rib 23 of the upper unit being positioned in alignment with the space between the sides 44*a* and 43*a* of the rib 22*a* and 21*a*, respectively, of the unit 13*a*. Similarly, the rib 30*a* is positioned in alignment with the longitudinal slot space between the side surfaces 43 and 44 of the ribs 21 and 22 of the top unit 13. It will thus be seen that the outer arcuate surfaces of the ribs of the two guide units are lying in a complete 360 degree cylindrical plane. If desired the ribs 23 and 23*a* may be made somewhat wider or slightly less than the width of the space between the side surfaces 43 and 44 and 44*a* and 43*a* as long as the three ribs are of such dimensions as to ensure that at any point of rotation of the rod guide with its rod shank will still maintain at least two ribs of the two units in engagement with the internal surfaces of the tubing in which the rod is positioned regardless of the rotational position of the rod shank relative to the internal surfaces of the tubing.

It will be apparent that the provision of the two guide units while providing the desired continuous contact with the internal surfaces of the well tubing at locations of lateral displacement of the rod shank relative to the well tubing minimizes the turbulance of the well fluids flowing upwardly past the rod guide by allowing a large relatively long space to permit the slight rotation of the well fluids during their upward movement between the two units of the rod guide. The distance between the upper end of the bottom unit and the bottom end of the top unit may be two to sixteen inches.

It will now be seen that a rod guide unit has been illustrated and described which will at all times during the rotation of the rod shank on which it is installed will have at least two ribs of the two units in contact with the internal surfaces of the well tubing to prevent any rapid and violent rotation of the rod as the rod string is rotated by the rotater.

It will also be seen that the flex portion 40 may be of some length so as to minimize the turbulence of the well fluid upwardly past the rod guide and that the length of the flex portion 40 may be at least one half inch and not more than sixteen inches long.

The foregoing description of the invention is explanatory only and changes in the detail of the construction illustrated may be made by those skilled in the art within the scope of the appended claims without departing from the spirit of the invention.

What is claimed as new and desired to be secured by Letters Patent is:

1. A rod guide of a shank of a rod which is positionable in a well tubing, said guide including: a pair of longitudinally spaced units rigidly secured to the shank of a rod, each unit including a tubular elongate body, a first rib, a second rib and a third rib extending outwardly from said body, the ribs of one of said units being displaced relative to the ribs of the other of said units about the longitudinal central axis of the rod, the ribs of said units having outer surfaces extending substantially in a complete cylindrical plane concentric with the longitudinal axis of the rod shank and having a diameter slightly smaller than the internal diameter of the well tubing, a portion of the rod shank between the two units constituting a flex portion of the rod shank.

2. The rod guide of claim 1 wherein said first and said second ribs of each unit each have a side surface lying in a plane diametric with the longitudinal axis of the shank of the rod and second side surfaces extending substantially perpendicular to said first side surfaces, said third ribs extending perpendicularly from said first side surfaces of said first and second ribs and having a width substantially equal to the distance between said second sides of said first and second ribs.

3. The rod guide of claim 2 wherein said first, second and third ribs of each unit are displaced relative to one another substantially one hundred and eighty degrees about the longitudinal axis of the shank.

4. The rod guide of claim 3 wherein opposite end surfaces of said tubular body and said ribs extend divergently inwardly from said outer surfaces to said rod shank.

5. The rod guide of claim 1 wherein at least two ribs of said two units are in contact with the well tubing when said shank is displaced laterally relative to the longitudinal axis of the well tubing are in contact with the well tubing.

6. The rod guide of claim 5, wherein said first and said second ribs of each unit each have a side surface lying in a plane diametric with the longitudinal axis of the shank of the rod and second side surfaces extending substantially perpendicular to said first side surfaces, said third ribs extending perpendicularly from said first side surfaces of said first and second ribs and having a width substantially equal to the distance between said second sides of said first and second ribs.

7. The rod guide of claim 6 where said first, second and third ribs of each unit are displaced relative to one another substantially one hundred and eighty degrees about the longitudinal axis of the shank.

8. The rod guide of claim 7 wherein opposite end surfaces of said tubular body and said ribs extend divergently inwardly from said outer surfaces to said rod shank.

* * * * *